US009630176B2

(12) United States Patent
Lay et al.

(10) Patent No.: US 9,630,176 B2
(45) Date of Patent: Apr. 25, 2017

(54) MICROFLUIDICS SYSTEMS WITH WASTE HOLLOW

(71) Applicant: Tecan Trading AG, Mannedorf (CH)

(72) Inventors: Tiffany Lay, San Jose, CA (US); Thomas D. Perroud, San Jose, CA (US); Michael Benjamin Franklin, Bailey, CO (US); Anne R. Kopf-Sill, Portola Valley, CA (US)

(73) Assignee: TECAN TRADING AG, Mannedorf (CH)

( * ) Notice: Subject to any disclaimer, the term of this patent is extended or adjusted under 35 U.S.C. 154(b) by 955 days.

(21) Appl. No.: 13/902,384

(22) Filed: May 24, 2013

(65) Prior Publication Data

US 2014/0190832 A1 Jul. 10, 2014

Related U.S. Application Data

(63) Continuation-in-part of application No. 13/737,656, filed on Jan. 9, 2013, now Pat. No. 9,377,439.

(51) Int. Cl.
*B01L 3/00* (2006.01)
*B01L 9/00* (2006.01)

(52) U.S. Cl.
CPC ..... *B01L 3/502715* (2013.01); *B01L 3/505* (2013.01); *B01L 3/502792* (2013.01);
(Continued)

(58) Field of Classification Search
CPC ..... B01L 3/56; B01L 3/502715; B01L 3/502792; B01L 3/505; B01L 3/5055;
(Continued)

(56) References Cited

U.S. PATENT DOCUMENTS 5,486,337 A 1/1996 Ohkawa
6,565,727 B1 5/2003 Shenderov
(Continued)

FOREIGN PATENT DOCUMENTS

EP 2 548 646 1/2013
WO WO 2006081558 8/2006
(Continued)

OTHER PUBLICATIONS

Pollack, M.G., et al.; Electrowetting-based actuation of droplets for integrated microfluidics; The Royal Society of Chemistry, Lab Chip, 2002, 2, 96-101.
(Continued)

*Primary Examiner* — Luan Van
*Assistant Examiner* — Maris R Kessel
(74) *Attorney, Agent, or Firm* — Notaro, Michalos & Zaccaria P.C.

(57) ABSTRACT

Digital microfluidics system manipulates samples in liquid droplets within a gap of at least one disposable cartridge. It is also provides additional space for collecting and/or storing waste fluids in this digital microfluidics system. It includes at least one waste hollow which is fluidly connected with a gap of a disposable cartridge that includes a bottom layer with a first hydrophobic surface and a top layer with a second hydrophobic surface. The waste hollow is located next to at least one individual waste electrode that is positioned next to at least one individual electrode of an electrode array. Each individual waste electrode is operatively connected to a central control unit and covers in each case a waste electrode area.

17 Claims, 3 Drawing Sheets

Figure 1:
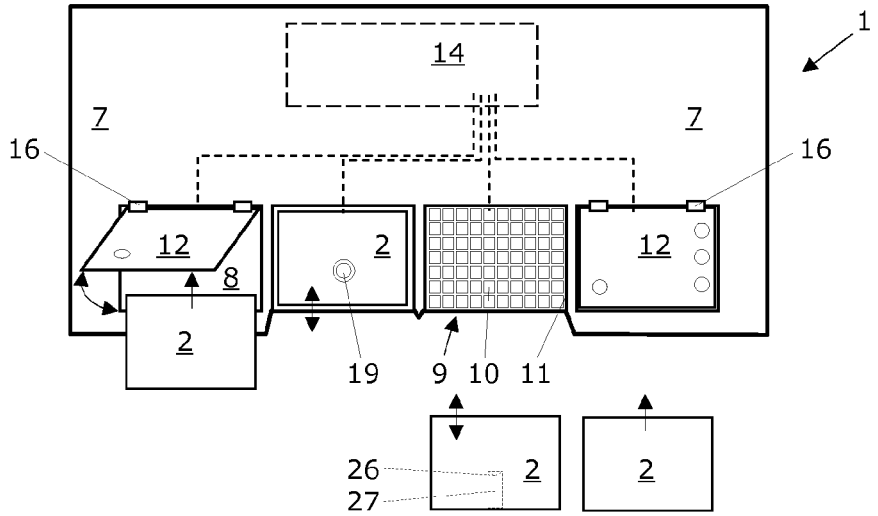

(52) U.S. Cl.
CPC ..... *B01L 9/527* (2013.01); *B01L 2200/025* (2013.01); *B01L 2200/027* (2013.01); *B01L 2200/0673* (2013.01); *B01L 2300/043* (2013.01); *B01L 2300/044* (2013.01); *B01L 2300/089* (2013.01); *B01L 2300/123* (2013.01); *B01L 2400/0427* (2013.01)

(58) Field of Classification Search
CPC ..... B01L 9/527; B01L 2200/027; B01L 2200/0673; B01L 2200/025; B01L 2300/043; B01L 2300/089; B01L 2300/123; B01L 2400/0427
See application file for complete search history.

(56) References Cited

U.S. PATENT DOCUMENTS

2006/0039823 A1* 2/2006 Yamakawa ..... B01F 11/0071 422/63
2008/0281471 A1 11/2008 Smith et al.
2009/0298059 A1 12/2009 Gumbrecht et al.
2011/0240471 A1* 10/2011 Wheeler ..... B01L 3/502784 204/451
2011/0290647 A1* 12/2011 Feiglin ..... B01L 3/0268 204/450
2013/0020202 A1 1/2013 Feiglin et al.
2013/0118900 A1 5/2013 Reimitz et al.

FOREIGN PATENT DOCUMENTS

WO WO 2006125767 11/2006
WO WO 2008106678 9/2008
WO WO 2010069977 6/2010
WO WO 2011002957 1/2011

OTHER PUBLICATIONS

Washizu, Masao; Electrostatis Actuation of Liquid Droplets for Microreactor Applications; IEEE Transactions on Industry Applications, vol. 34, No. 4, Jul./Aug. 1998, pp. 732-737.
Yang, Hanping, et al.; Connecting interface for modularization of digital microfluidics; Proc. of SPIE vol. 6886, 68860L-1, (2008).
International Search Report for PCT/EP2013/060585.

* cited by examiner

MICROFLUIDICS SYSTEMS WITH WASTE HOLLOW

RELATED PATENT APPLICATIONS

The present patent application is a Continuation In Part application to the U.S. CIP application Ser. No. 13/737,656 filed on Jan. 9, 2013, the entire content of which is herein incorporated by explicit reference for all purposes. The entire content of the co-pending U.S. patent application Ser. No. 13/188,584, published as US 2013/0020202 A1, is herein incorporated in its entirety. The entire content of the co-pending and non-published patent application U.S. Ser. No. 13/900,712 of May 23, 2013 is herein incorporated by explicit reference as well.

FIELD OF TECHNOLOGY

The present invention relates to digital microfluidics systems for manipulating samples in liquid droplets. The digital microfluidics systems comprise an electrode array supported by a substrate, and a central control unit for controlling the selection of individual electrodes of this electrode array and for providing them with individual voltage pulses for manipulating liquid droplets by electrowetting. The invention also relates to a digital microfluidics system for facilitating droplet actuated molecular techniques and to an alternative method for manipulating samples in liquid droplets digital in a microfluidics system or device. This technical field generally relates to the control and manipulation of liquids in a small volume, usually in the micro- or nanoscale format. In digital microfluidics, a defined voltage is applied to electrodes of an electrode array, so that individual droplets are addressed (electrowetting). For a general overview of the electrowetting method, please see Washizu, IEEE Transactions on Industry Applications, Volume 34, No. 4, 1998, and Pollack et al., *Lab chip,* 2002, Volume 2, 96-101. Briefly, electrowetting refers to a method to move liquid droplets using arrays of microelectrodes, preferably covered by a hydrophobic layer. By applying a defined voltage to electrodes of the electrode array, a change of the surface tension of the liquid droplet, which is present on the addressed electrodes, is induced. This results in a remarkable change of the contact angle of the droplet on the addressed electrode, hence in a movement of the droplet. For such electrowetting procedures, two principle ways to arrange the electrodes are known: using one single surface with an electrode array for inducing the movement of droplets or adding a second surface that is opposite a similar electrode array and that provides at least one ground electrode. A major advantage of the electrowetting technology is that only a small volume of liquid is required, e.g. a single droplet. Thus, liquid processing can be carried out within considerably shorter time. Furthermore the control of the liquid movement can be completely under electronic control resulting in automated processing of samples.

RELATED PRIOR ART

Automated liquid handling systems are generally well known in the art. An example is the Freedom EVO® robotic workstation from the present applicant (Tecan Schweiz AG, Seestrasse 103, CH-8708 Mannedorf, Switzerland). This device enables automated liquid handling in a stand-alone instrument or in automated connection with an analytical system. These automated systems are larger systems that are not designed to be portable and typically require larger volumes of liquids (microliter to milliliter) to process.

A device for liquid droplet manipulation by electrowetting using one single surface with an electrode array (a monoplanar arrangement of electrodes) is known from the U.S. Pat. No. 5,486,337. All electrodes are placed on a surface of a carrier substrate, lowered into the substrate, or covered by a non-wettable surface. A voltage source is connected to the electrodes. The droplet is moved by applying a voltage to subsequent electrodes, thus guiding the movement of the liquid droplet above the electrodes according to the sequence of voltage application to the electrodes.

An electrowetting device for microscale control of liquid droplet movements, using an electrode array with an opposing surface with at least one ground electrode is known from U.S. Pat. No. 6,565,727 (a biplanar arrangement of electrodes). Each surface of this device may comprise a plurality of electrodes. The two opposing arrays form a gap. The surfaces of the electrode arrays directed towards the gap are preferably covered by an electrically insulating, hydrophobic layer. The liquid droplet is positioned in the gap and moved within a non-polar filler fluid by consecutively applying a plurality of electric fields to a plurality of electrodes positioned on the opposite sites of the gap.

Containers with a polymer film for manipulating samples in liquid droplets thereon are known from WO 2010/069977 A1: A biological sample processing system comprises a container for large volume processing and a flat polymer film with a lower surface and a hydrophobic upper surface. The flat polymer film is kept at a distance to a base side of the container by protrusions. This distance defines at least one gap when the container is positioned on the film. A substrate supporting at least one electrode array is also disclosed as well as a control unit for the liquid droplet manipulation instrument. The container and the film are reversibly attached to the liquid droplet manipulation instrument. The system thus enables displacement of at least one liquid droplet from the at least one well through the channel of the container onto the hydrophobic upper surface of the flat polymer film and above the at least one electrode array. The liquid droplet manipulation instrument is accomplished to control a guided movement of said liquid droplet on the hydrophobic upper surface of the flat polymer film by electrowetting and to process there the biological sample.

The use of such an electrowetting device for manipulating liquid droplets in the context of the processing of biological samples is also known from the international patent application published as WO 2011/002957 A2. There, it is disclosed that a droplet actuator typically includes a bottom substrate with the control electrodes (electrowetting electrodes) insulated by a dielectric, a conductive top substrate, and a hydrophobic coating on the bottom and top substrates. From this document, droplet actuators with a fixed bottom substrate (e.g. of a PCB), with electrowetting electrodes, and with a removable or replaceable top substrate are known. A self-containing cartridge may e.g. include buffers, reagents, and filler fluid. Pouches in the cartridge may be used as fluid reservoirs and may be punctured to release fluid (e.g. a reagent or oil) into a cartridge gap. The cartridge may include a ground electrode, which may be replaced by a hydrophobic layer, and an opening for loading samples into the gap of the cartridge. Interface material (e.g. a liquid, glue or grease) may provide adhesion of the cartridge to the electrode array.

Disposable cartridges for microfluidic processing and analysis in an automated system for carrying out molecular diagnostic analysis are disclosed in WO 2006/125767 A1

(see US 2009/0298059 A1 for an English translation). The cartridge is configured as a flat chamber device (with about the size of a check card) and can be inserted into the system. A sample can be pipetted into the cartridge through a port.

Droplet actuator structures are known from the international patent application WO 2008/106678. This document particularly refers to various wiring configurations for electrode arrays of droplet actuators, and additionally discloses a two-layered embodiment of such a droplet actuator which comprises a first substrate with a reference electrode array separated by a gap from a second substrate comprising control electrodes. The two substrates are arranged in parallel, thereby forming the gap. The height of the gap may be established by spacer. A hydrophobic coating is in each case disposed on the surfaces which face the gap. The first and second substrate may take the form of a cartridge, eventually comprising the electrode array.

Objects and Summary of the Present Invention

Some assays require many droplets of a give reagent (e.g. wash buffer), thus larger liquid volumes need to be collected and/or stored in a space that is fluidly connected with the gap where the electrowetting manipulation for carrying out these assays is performed. It is therefore an object of the present invention to suggest alternative digital microfluidics systems or digital microfluidics devices which are configured to accommodate one or more disposable cartridges for manipulating therein samples in liquid droplets and which are configured to collect and/or store larger waste liquid volumes.

This object is achieved in that a digital microfluidics system for manipulating samples in liquid droplets within a gap of at least one disposable cartridge is provided. Such a digital microfluidics system comprises:

(a) a base unit with at least one cartridge accommodation site that is configured for taking up a disposable cartridge;
(b) a disposable cartridge that comprises a gap with a gap height, a bottom layer with a first hydrophobic surface, and a top layer with a second hydrophobic surface, said disposable cartridge being placed at said cartridge accommodation site;
(c) an electrode array located at said cartridge accommodation site of the base unit, the electrode array being supported by a bottom substrate, substantially extending in a first plane, and comprising a number of individual electrodes; and
(d) a central control unit for controlling the selection of the individual electrodes of said electrode array and for providing these electrodes with individual voltage pulses for manipulating liquid droplets within the gap of said cartridge by electrowetting.

The digital microfluidics system according to the present invention is characterized in that it further comprises a waste hollow which is fluidly connected with the gap in that the waste hollow is located next to at least one individual waste electrode that is positioned next to at least one individual electrode, the at least one individual waste electrode being operatively connected to the central control unit and covering in each case a waste electrode area, said waste hollow covering a waste area that is equal to a multitude of said waste electrode area and said waste hollow having a height that is equal to a multitude of the gap height.

According to a first alternative solution of the inventive digital microfluidics system, the bottom layer of the disposable cartridge is configured to be flexible and the waste hollow is configured as a depression or hole in the bottom substrate of the digital microfluidics system, which further comprises:

(e) a number of suction holes that penetrate the bottom substrate and the electrode array and that are distributed over the cartridge accommodation site of the base unit and over the waste hollow;
(f) a vacuum source for establishing an underpressure in an evacuation space that is located between the electrode array or bottom substrate and a disposable cartridge located thereon; and
(g) a number of vacuum lines that link the suction holes to the vacuum source.

According to this first alternative digital microfluidics system, the flexible bottom layer of the disposable cartridge is configured to be attracted by the underpressure in the evacuation space and to be spread over the electrode array, the bottom substrate, and over the waste hollow in the bottom substrate of the digital microfluidics system, the flexible bottom layer thereby defining the gap height of the gap between the bottom layer and the top layer of the disposable cartridge and also the area and height of the waste hollow.

According to a second alternative solution of the inventive digital microfluidics system, the disposable cartridge comprises a body, in which body the waste hollow is located, the waste hollow being in fluidic communication with the gap that is located between the bottom layer and the top layer of the disposable cartridge; the height of the waste hollow including the height of the gap.

Additional and inventive features and preferred embodiments and variants of the digital microfluidics system derive from the respective dependent claims.

Advantages of the present invention comprise:

The waste hollows of the present invention provide large volumes for collecting and/or storing waste liquids, such as e.g. wash buffers that are necessary for some assays to be carried out properly.

The digital microfluidics systems of the present invention comprise a disposable cartridge in which at least one waste hollow is enclosed. The collected waste liquids are disposed together with the cartridge and thus cannot pollute the microfluidics system or the surrounding laboratory.

A first alternative solution of the inventive digital microfluidics system provides a waste hollow in the PCB (configured as a depression or through hole), a flexible bottom layer of the disposable cartridge being configured as the working layer of the gap and as a film that dips into the depression or through hole in the PCB and/or substrate of the electrode array, thus creating a much deeper gap in the area of the waste hollow.

A second alternative solution of the inventive digital microfluidics system provides a waste hollow in the body of a disposable cartridge, the waste hollow being in fluidic communication with the gap that is located between the bottom layer and the top layer of the disposable cartridge; the height of the waste hollow including the height of the gap.

The waste hollows of the present invention are built to take up much larger volumes of waste liquid than a waste electrode located in the gap (e.g. as known from US 2013/0020202 A1).

BRIEF INTRODUCTION OF THE DRAWINGS

Figure 2:
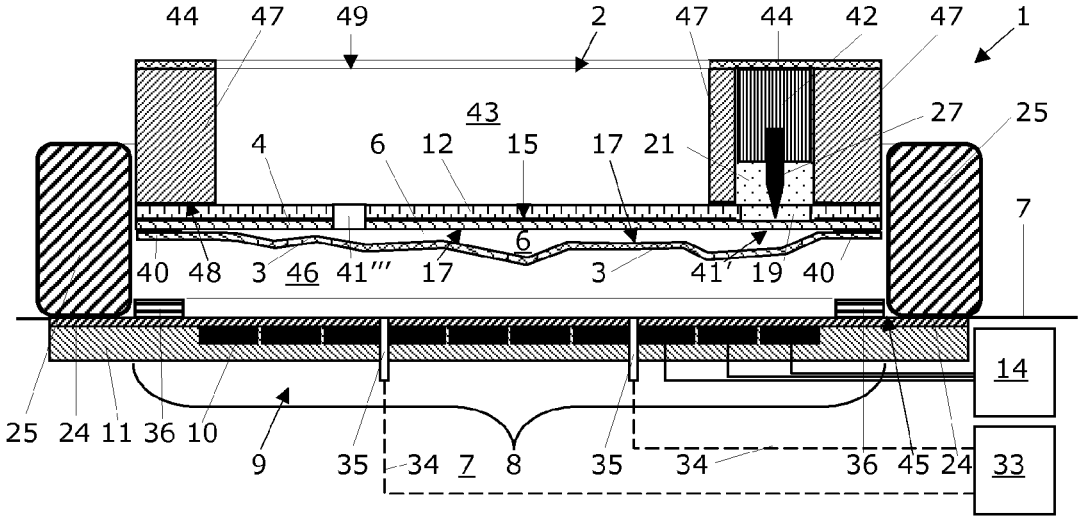
Figure 3:
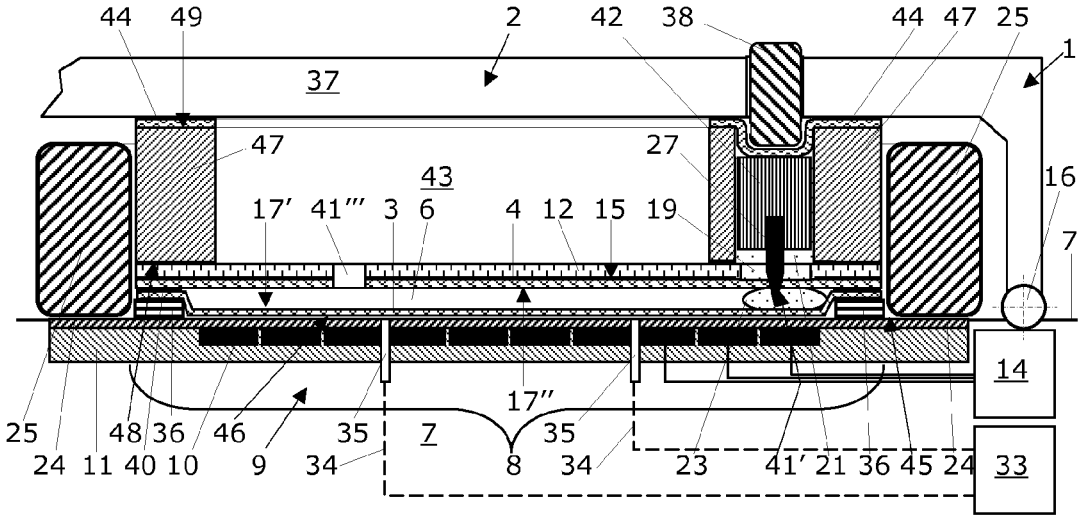
Figure 4:
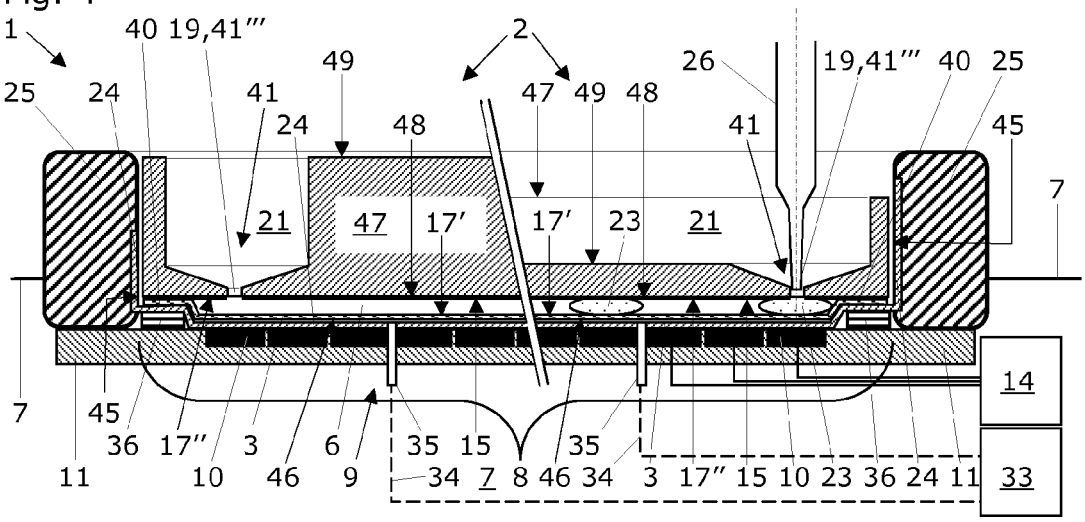
Figure 5:
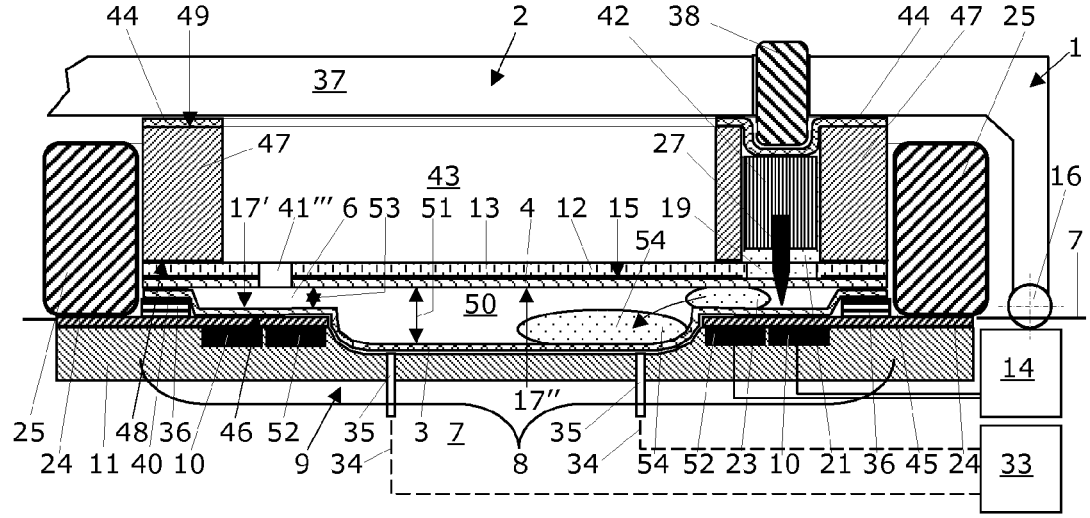
Figure 6:
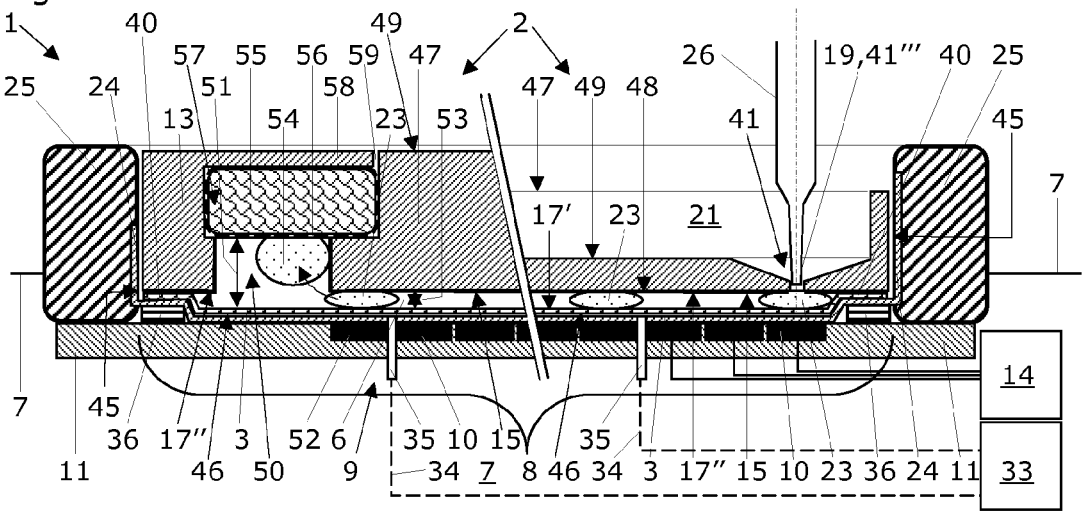
Figure 7:
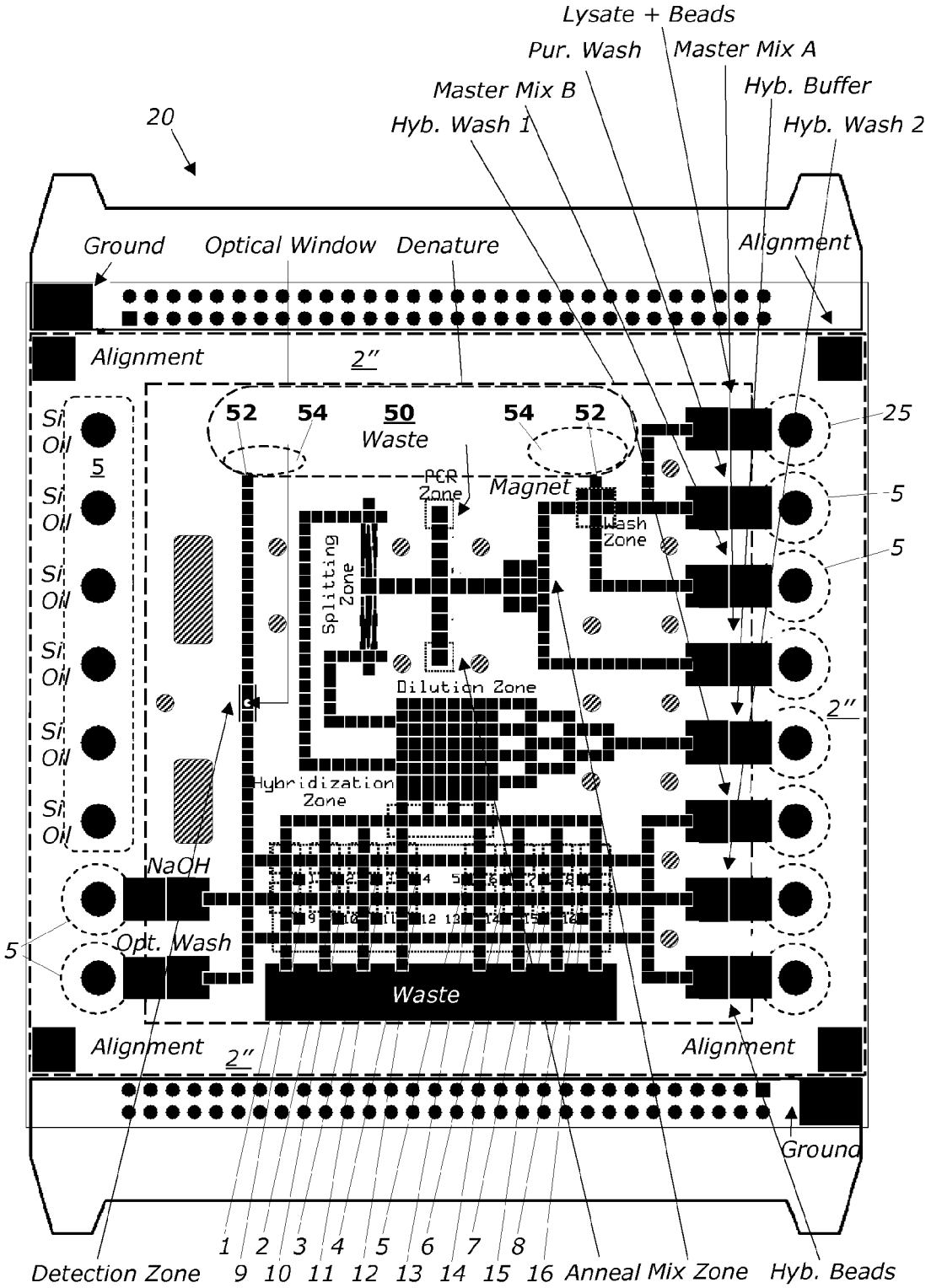

The digital microfluidics system and two embodiments of the waste hollow according to the present invention are explained with the help of the attached schematic drawings that show selected and exemplary embodiments of the present invention without narrowing the scope and gist of this invention. It is shown in:

FIG. 1 an overview over a digital microfluidics system that is equipped with a central control unit and a base unit, with four cartridge accommodation sites that each comprise an electrode array, and a movable cover plate;

FIG. 2 a section view of one disposable cartridge before reaching its accommodation site, the disposable cartridge being configured according to a first embodiment;

FIG. 3 a section view of the disposable cartridge of FIG. 2 after reaching its accommodation site, the disposable cartridge being configured according to the first embodiment and being hold in place by a clamp;

FIG. 4 a section view of a disposable cartridge after reaching its accommodation site, the disposable cartridge being configured according to a second embodiment and being hold in place without a clamp;

FIG. 5 a section view of the disposable cartridge of FIG. 3, the flexible bottom layer of the disposable cartridge according to a third embodiment being attracted by under-pressure and spread over the electrode array, the bottom substrate, and over the waste hollow in the bottom substrate of the digital microfluidics system;

FIG. 6 a section view of a disposable cartridge of FIG. 4, the disposable cartridge according to a sixth embodiment comprising a body, in which the waste hollow is located, the waste hollow being in fluidic communication with the gap that is located between the bottom layer and the top layer of the disposable cartridge;

FIG. 7 a top view of an electrode layout of a system for liquid droplet manipulation of US 2013/0020202 A1 (see there FIG. 9) in which is incorporated a waste hollow according to the first alternative solution as shown in FIG. 5.

DETAILED DESCRIPTION OF THE PRESENT INVENTION

The FIG. 1 shows an overview over an exemplary digital microfluidics system 1 that is equipped with a central control unit 14 and a base unit 7, with four cartridge accommodation sites 8 that each comprise an electrode array 9, and a cover plate 12. The digital microfluidics system 1 is configured for manipulating samples in liquid droplets 23 within disposable cartridges 2 that contain a bottom layer 3, a top layer 4, and eventually a spacer 5 that defines a gap 6 between the bottom and top layers 3,4. Accordingly, the samples in liquid droplets 23 are manipulated in the gap 6 of the disposable cartridge 2.

A typical digital microfluidics system 1 comprises a base unit 7 with at least one cartridge accommodation site 8 that is configured for taking up a disposable cartridge 2. The digital microfluidics system 1 can be a stand alone and immobile unit, on which a number of operators is working with cartridges 2 that they bring along. The digital microfluidics system 1 thus may comprise a number of cartridge accommodation sites 8 and a number of electrode arrays 9, so that a number of cartridges 2 can be worked on simultaneously and/or parallel. The number of cartridge accommodation sites 8, electrode arrays 9, and cartridges 2 may be 1 or any number between e.g. 1 and 100 or even more; this number e.g. being limited by the working capacity of the central control unit 14.

It may be preferred to integrate the digital microfluidics system 1 into a liquid handling workstation or into a Freedom EVO® robotic workstation, so that a pipetting robot can be utilized to transfer liquid portions and/or sample containing liquids to and from the cartridges 2. Alternatively, the system 1 can be can be configured as a hand held unit which only comprises and is able to work with a low number, e.g. a single disposable cartridge 2. Every person of skill will understand that intermediate solutions that are situated in-between the two extremes just mentioned will also operate and work.

A typical digital microfluidics system 1 also comprises at least one electrode array 9 that substantially extends in a first plane and that comprises a number of individual electrodes 10. Such an electrode array 9 is located at each one of said cartridge accommodation sites 8 of the base unit 7. Preferably each electrode array 9 is supported by a bottom substrate 11, which bottom substrate 11 is fixed to the base unit 7. It is noted that the expressions "electrode array", "electrode layout", and "printed circuit board (PCB)" are utilized herein as synonyms. It is expressly noted as well that the first plane of the electrode array 9 may extend in any arbitrary spatial direction. The same is true for the second plane of the cover plate 12 as long as the first and second plane extend substantially parallel to each other.

A typical digital microfluidics system 1 also comprises at least one cover plate 12 with a top substrate 13. In each case, at least one cover plate 12 is located at said cartridge accommodation sites 8. The top substrate 13 of the cover plate 12 and the bottom substrate 11 with the electrode array 9 or PCB define a space or cartridge accommodation site 8 respectively. In a first variant (see the two cartridge accommodation sites 8 in the middle of the base unit 7), the cartridge accommodation sites 8 are configured for receiving a slidingly inserted disposable cartridge 2 that is movable in a direction substantially parallel with respect to the electrode array 9 of the respective cartridge accommodating site 8. Such front- or top-loading can be supported by a drawing-in automatism that, following a partial insertion of a disposable cartridge 2, transports the cartridge 2 to its final destination within the cartridge accommodation site 8, where the cartridge 2 is precisely seated. Preferably, these cartridge accommodation sites 8 do not comprise a movable cover plate 12. After carrying out all intended manipulations to the samples in liquid droplets, the used cartridges 2 can be ejected by the drawing-in automatism and transported to an analysis station or discarded.

In a second variant (see the two cartridge accommodation sites 8 on the right and left of the base unit 7), the cartridge accommodation sites 8 comprise a cover plate 12 that is configured to be movable with respect to the electrode array 9 of the respective cartridge accommodating site 8. The cover plate 12 preferably is configured to be movable about one or more hinges 16 and/or in a direction that is substantially normal to the electrode array 9.

A typical digital microfluidics system 1 also comprises a central control unit 14 for controlling the selection of the individual electrodes 10 of said at least one electrode array 9 and for providing these electrodes 10 with individual voltage pulses for manipulating liquid droplets within said cartridges 2 by electrowetting. As partly indicated in FIG. 1, every single individual electrode 10 is operatively connected to the central control unit 14 and therefore can be independently addressed by this central control unit 14, which also comprises the appropriate sources for creating and providing the necessary electrical potentials in a way known in the art.

The at least one cover plate 12 further comprises an electrically conductive material 15 that extends in a second plane and substantially parallel to the electrode array 9 of the cartridge accommodation site 8 the at least one cover plate 12 is assigned to. This electrically conductive material 15 of the cover plate 12 preferably is configured to be connected to a source of an electrical ground potential. This conductive material 15 contributes to the electrowetting movements of the liquid droplets manipulated in the digital microfluidics system 1.

In all embodiments shown or discussed, it is preferred that the gap 6 of the disposable cartridge 2 is substantially filled with silicon oil. It is also always preferred that the bottom layer 3 and the top layer 4 of the cartridge 2 are entirely hydrophobic films or comprise a hydrophobic surface 17', 17" that is exposed to the gap 6 of the cartridge 2. Following electrowetting and manipulating at least one liquid droplet 23 with the gap 6 of a disposable cartridge 2, the result of the manipulation or of the assay can be evaluated while the disposable cartridge 2 still is at the cartridge accommodation site 8, i.e. utilizing an analysis system of the digital microfluidics system 1 or of a workstation, the digital microfluidics system 1 is integrated into. Alternately, the disposable cartridges 2 can be taken out of the base unit 7 of the digital microfluidics system 1 and samples in manipulated can be analyzed elsewhere.

After analysis, the disposable cartridges 2 can be disposed and the electrode array 9 can be reused. Because the components of the digital microfluidics system 1 never come into contact with any samples or reagents when working with one of the embodiments of the cartridge 2, such re-usage with other disposable cartridges 2 can be immediately and without any intermediate cleaning. Because the through hole 19 of the cover plate 12 of the digital microfluidics system 1 may come into contact with samples and reagents when working with the third or fourth embodiment of the cartridge 2, such re-usage with other disposable cartridges 2 can be carried out after some intermediate cleaning or after replacement of the cover plates 12.

It is an aim of the present invention to provide removable and disposable cartridges with working films that separate the liquid droplets 23 from the electrode array 9 during manipulation of the liquid droplets 23 by electrowetting. As shown in the three different embodiments of the self-containing disposable cartridge 2 presented in the specification, the removable and disposable films preferably are provided as a bottom layer 3 and a top layer 4 of a cartridge 2.

In a preferred embodiment, the bottom layer 3 of the cartridge 2 is attracted to the PCB by vacuum. Small evacuation holes in the PCB are connected to a vacuum pump for this purpose. Applying such vacuum attraction to the bottom layer 3 enables avoiding the use of any liquids or adhesives for better contacting the bottom layer 3 of the cartridge 2 to the surface of the electrode array 9.

In the attached FIGS. 2, 3 and 4, especially preferred embodiments of a disposable cartridge according to a first and second embodiment are shown. In each case, the disposable cartridge 2 comprises a body 47 with at least one compartment 21 that is configured to hold therein processing liquids, reagents or samples. At least one of said compartments 21 comprises a through hole 19 for delivering at least some of its content to a gap 6 below. The disposable cartridge 2 also comprises a bottom layer 3 with a first hydrophobic surface 17' that is impermeable to liquids and that is configured as a working film for manipulating samples in liquid droplets 23 thereon utilizing an electrode array 9 of a digital microfluidics system 1 when the bottom layer 3 of the disposable cartridge 2 is placed over said electrode array 9. The disposable cartridge 2 further comprises a top layer 4 with a second hydrophobic surface 17" that is impermeable to liquids and that is attached to a lower surface 48 of the body 47 of the disposable cartridge 2. Moreover, the disposable cartridge 2 comprises a gap 6 that is located between the first hydrophobic surface 17' of the bottom layer 3 and the second hydrophobic surface 17" of the top layer 4. The bottom layer 3 of the inventive cartridge 2 is configured as a flexible film that is sealingly attached to the top layer 4 along a circumference 40 of the flexible bottom layer 3. Thus, the disposable cartridge 2 is devoid of any spacer 5 that is located between the flexible bottom layer 3 and the top layer 4 for defining a particular distance between said first hydrophobic surface 17' and said second hydrophobic surface 17". The top layer 4 is configured to provide a seal between a lower end of at least one compartment 21 and the gap 6. In addition, the top layer 4 comprises loading sites 41 for transferring processing liquids, reagents or samples into the gap 6.

In FIG. 2, a section view of one disposable cartridge 2 before reaching its accommodation site 8 is presented. The flexible bottom layer 3 is seen as it is only attached to the top layer 4 around its circumference 40, the majority of the bottom layer 3 being loosely suspended from its circumference 40 and being not in contact with the top layer 4. Accordingly, before correctly placing the disposable cartridge 2 in or on the cartridge accommodation site 8, the gap 6 is enclosed but not defined in its width and parallel orientation. The body 47 of the disposable cartridge 2 here comprises an essentially flat lower surface 48 and is configured as a frame structure with a central opening 43 that penetrates the entire frame structure.

In FIG. 3, a section view of the disposable cartridge 2 of FIG. 2 is depicted after the disposable cartridge 2 reaching its cartridge accommodation site 8 on the electrode array of a digital microfluidics system 1. The disposable cartridge 2 is configured according to the first embodiment and is hold in place by a clamp 37. On one side, the clamp 37 preferably is attached to the substrate 11 of the base unit 7 of the digital microfluidics system 1 by a hinge 16. On the other side, the clamp 37 may be attached to the substrate 11 of the base unit 7 of the digital microfluidics system 1 by e.g. a clip, a snap-lock, or a screw (not shown).

In the first embodiment of FIGS. 2 and 3, the disposable cartridge 2 further comprises a plane rigid cover plate 12 that is attached to the lower surface 48 of the body 47 of the disposable cartridge 2. The top layer 4 is attached to said rigid cover plate 12, which rigid cover plate 12 comprises through holes 19 that are located at the loading sites 41 (here at the piercing site 41' and at the capillary orifice) of the top layer 4. The rigid cover plate 12 here provides for a straight attachment surface for the top layer 4 and also comprises the through hole 19. The cover plate may be manufactured from a rigid material like clear Mylar® (trademark of DuPont Teijin; a film from polyethylene terephthalate, PET). The rigid cover may be coated (preferably on the lower side) with an electrically conductive material 15, e.g. from titanium indium oxide (TIO) or from a plastic material with electrically conductive filler materials in order to achieve the function of the cover plate 12 as described before. As indicated with darker lines, the cover plate 12 is attached to the lower surface 48 of the body 47 of the disposable cartridge 2. This attachment may be achieved by the use of an adhesive tape or a glue strip that preferably is from a chemically inert material just like the Mylar. Depending on the material of the body 47 of the cartridge 2, also welding methods can be applied for attaching the cover plate 12 to the cartridge 2. As indicated with darker lines, the top layer 4 here is sealingly attached to the lower surface 48 of cover plate 12. This attachment of the top layer 4 can be carried out by using an adhesive tape or a glue strip, or by welding (e.g. by laser welding). The flexible bottom layer 3 is sealingly attached to the top layer 4 along the circumference 40 of the flexible bottom layer 3 by using an adhesive tape or a glue strip, or by applying a welding technique.

In FIG. 2, a pipetting orifice 41''' is depicted as well. Such pipetting orifices 41''' that are located in the central opening 43 of the disposable cartridge 2 and that are configured to be accessible by a pipette tip can thus be used for pipetting of processing liquids, reagents or samples directly into the gap 6. Of course, the pipetting orifice 41''' comprises an opening in the cover plate 12 (if present) and a through hole in the top layer 4. Such pipetting orifices 41''' can be used in addition to or instead of one or more piecing orifices 41', which in each case are located below a compartment 21.

This disposable cartridge 2 comprises at least one plunger 42 that in each case is configured to be movable within a compartment 21 manually or by an actuating element 38 (see FIG. 3) for pressing the content of the respective compartment 21 against a respective loading site 41 of the top layer 4. The plunger 42 comprises a piercing pin 27 that is configured for piercing the top layer 4 at the respective loading site 41 of the compartment 21. Thus, the plunger 42 is configured for pressing some of the content of the compartment 21 through the piercing site 41' of the top layer 4 and into the gap 6. Alternatively, the plunger 42 is configured for pressing some of the content of the compartment 21 through a capillary orifice of the top layer 4 and into the gap 6. This capillary orifice preferably is sized to exhibit capillary forces that prevent flowing though of aqueous liquids without a pressure being applied with the plunger 42 (not shown). Thus, the loading sites 41 preferably are selected from a group comprising piercing sites 41', capillary orifices, and pipetting orifices 41'''.

If however, the plunger 42 is pressed down (see FIG. 3 on the right), the piercing pin 27 penetrates the through hole 19 in the cover layer 12 or body 47 and pierces the top layer 4. Concurrently, a portion of the content of the compartment 21, be it a processing liquid, a reagent or a sample (in a solution or suspension), is pressed by the plunger into the gap 6. As a result, on the first hydrophobic surface 17' of the bottom layer 3, a droplet 23 is built up and can be manipulated in the gap between this first hydrophobic surface 17' of the bottom layer 3 and the second hydrophobic surface 17" of the top layer 4. Manipulating the droplet 23 is effected by the electrode array 9 of the digital microfluidics system 1 the disposable cartridge 2 is accommodated on.

Alternatively, pressing down the plunger 42 shall force a portion of the contents of the compartment 21, be it a processing liquid, a reagent or a sample (in a solution or suspension), to be moved through the capillary orifice and into the gap 6 (not shown). As a result, on the first hydrophobic surface 17' of the bottom layer 3, a droplet 23 will be built up and can be manipulated in the gap between this first hydrophobic surface 17' of the bottom layer 3 and the second hydrophobic surface 17" of the top layer 4. Again, manipulating the droplet 23 will be effected by the electrode array 9 of the digital microfluidics system 1 the disposable cartridge 2 is accommodated on.

In the first embodiment of the disposable cartridge 2 of the present invention, it is one preferred alternative that the flexible bottom layer 3 is configured as a monolayer of a hydrophobic material. According to a second preferred alternative, the flexible bottom layer 3 is configured as a monolayer of electrically non-conductive material, the upper surface 17 of the flexible bottom layer 3 being treated to be hydrophobic. According to a third preferred alternative, the flexible bottom layer 3 is configured as a laminate comprising a lower layer and a hydrophobic upper layer, the lower layer being electrically conductive or non-conductive. According to another preferred embodiment of the disposable cartridge 2 of the present invention, a dielectric layer 24 is laminated onto the lower surface of the bottom layer 3 (see e.g. FIG. 4).

According to one variant of the first embodiment of the disposable cartridge of the present invention, the disposable cartridge 2 further comprises a gasket 36 that is attached to a lower surface and along a circumference 40 of the flexible bottom layer 3. The gasket 36 thus defining a particular distance between said first hydrophobic surface 17' and said second hydrophobic surface 17", when the disposable cartridge 2 is placed over an electrode array 9 of a digital microfluidics system 1. This is the case, if said digital microfluidics system 1 is equipped with suction holes 35 in the electrode array 9, and if the flexible bottom layer 3 is aspirated by said suction holes 35.

FIG. 4 shows a section view of a disposable cartridge 2 after reaching its accommodation site 8, the disposable cartridge 2 being configured according to a fourth embodiment and being hold in place without a clamp. Actually, two different variants of the fourth embodiment are shown:

- on the left side, the body 47 is configured as plate structure;
- on the right side, the body 47 is configured as frame structure;

with the lower surface 48 of the body 47 of the disposable cartridge 2 in both cases being essentially flat. Thus, the disposable cartridge 2 configured according to the fourth embodiment comprises a body 47 with a lower surface 48, an upper surface 49, and at least one through hole 19. The at least one through hole 19 is designed as a pipetting orifice 41''' that is configured to be accessible by a pipette tip 26. The through hole 19 and thus allows pipetting of processing liquids, reagents or samples into the gap 6.

In addition to the body 47, the disposable cartridge 2 comprises a bottom layer 3 with a first hydrophobic surface 17' that is impermeable to liquids and that is configured as a working film for manipulating samples in liquid droplets 23 thereon. Such manipulating is performed utilizing an electrode array 9 of a digital microfluidics system 1 when the bottom layer 3 of the disposable cartridge 2 is placed over said electrode array 9. Preferably, the flexible bottom layer 3 is sealingly attached to an electrically conductive material 15 along a circumference 40 of the flexible bottom layer 3 by an adhesive tape or a glue strip, or alternatively by welding.

The disposable cartridge 2 further comprises an electrically conductive material 15 attached to the lower surface 48 of the body 47. The electrically conductive material 15 is impermeable to liquids and is configured to provide the lower surface 48 of the body 47 with a second hydrophobic surface 17". The bottom layer 3 is configured as a flexible film that is sealingly attached to the electrically conductive material 15 of the disposable cartridge 2 along a circumference 40 of the flexible bottom layer 3, the disposable cartridge 2 thus being devoid of a spacer 5 (cv. FIGS. 2-6) that is located between the flexible bottom layer 3 and the electrically conductive material 15 for defining a particular distance between said first hydrophobic surface 17' and said second hydrophobic surface 17".

The disposable cartridge 2 further comprises a gap 6 that is located between the first hydrophobic surface 17' of the bottom layer 3 and the second hydrophobic surface 17" of the electrically conductive material 15. The at least one through hole 19 of the body 47 is configured as a loading site 41 for transferring processing liquids, reagents or samples into the gap 6.

The disposable cartridge 2 further comprises something like a compartment 21, which is configured as one or more container-like depressions in the body 47 located around one or more loading sites 41. However, these compartments 21 are not meant to store liquids over a long period of time or even during shipping, they are merely configured to allow a pipette tip 26 (disposable or not) to reach near the pipetting orifices 41''' located at the loading sites 41. Preferably, these "compartments 21" comprise a central depression around the loading sites 41, which central depression allows some liquid to be deposited temporarily prior to the transfer of the liquid into the gap 6.

As in all other embodiments previously shown, the flexible bottom layer 3 preferably is configured as a monolayer of a hydrophobic material. According to a first preferred alternative variant, the flexible bottom layer 3 is configured as a monolayer of electrically non-conductive material, an upper surface of the flexible bottom layer 3 being treated to be a hydrophobic surface 17. According to a second preferred alternative variant, the flexible bottom layer 3 is configured as a laminate comprising a lower layer and a hydrophobic upper layer, the lower layer being electrically conductive or non-conductive.

In an other alternative embodiment, the disposable cartridge 2 further comprises a gasket 36 that is attached to a lower surface and along a circumference 40 of the flexible bottom layer 3. The gasket 36 thus defining a particular distance between said first hydrophobic surface 17' and said second hydrophobic surface 17", when the disposable cartridge 2 is placed over an electrode array 9 of a digital microfluidics system 1, if said digital microfluidics system 1 is equipped with suction holes 35 in the electrode array 9, and if the flexible bottom layer 3 is aspirated by said suction holes 35.

In the FIG. 4, the gasket 36 is attached to the bottom substrate 11 that supports the individual electrodes 10 of the electrode array 9. Here, a dielectric layer 24 is attached to the surface of the electrode array 9, protecting the individual electrodes from oxidation, mechanical impact and other influences like contamination. The dielectric layer 24 also covers the gasket 36 that is configured as a closed ring that extends around the accommodation site 8 for the disposable cartridge 2. The dielectric layer 24 further covers at least a part of the insertion guide 25 and reaches over a part (see left side) or beyond the entire height of the disposable cartridge 2 (see right side).

According to the first and second embodiment of the of the disposable cartridge 2 of the present invention described so far, it is also proposed an alternative digital microfluidics system that is configured to take up at least one of these inventive disposable cartridges 2 in its cartridge accommodation sites 8 located on the electrode array 9 of the base unit 7.

According to another variant of the first and second embodiment of the disposable cartridge 2 of the present invention, the disposable cartridge 2 does not comprise a gasket 36. Instead, the gasket 36 is permanently fixed to the bottom substrate 11 of the base unit 7 of the digital microfluidics system 1, or the gasket 36 is fixed to a dielectric layer 24 that permanently covers the electrode array 9 and the bottom substrate 11. Of course in this case, the dielectric layer 24 has holes at the sites of the suction holes 35 of the base unit 7 in order to enable formation of the underpressure in the evacuation space 46, which causes the flexible bottom layer 3 of the disposable cartridge 2 that is placed on the cartridge accommodation site 8 to be attracted and spread over the electrode array 9 and bottom substrate 11 of the digital microfluidics system 1.

According to a further variant of the first and second embodiment of the disposable cartridge 2 of the present invention, the gasket 36 is permanently attached to a lower surface and along a circumference 40 of the flexible bottom layer 3 of a disposable cartridge 2 to be placed on the cartridge accommodation site 8 of the base unit 7.

The inventive digital microfluidics system 1 preferably is equipped with a base unit 7, which comprises an insertion guide 25 that is configured as a frame, which is sized to accommodate a disposable cartridge 2 therein. It is especially preferred that the base unit 7 comprises a clamp 37 that is configured to fix this disposable cartridge 2 at a desired position on the cartridge accommodation site 8 of the base unit 7. As demonstrated in connection with the second embodiment (see FIG. 4), there is no absolute need for using such a clamp 37. Here, the layers are all sealed well and the vacuum in the evacuation space 46 on the bottom surface holds the disposable cartridge 2 safely in place and within the cartridge accommodation site 8 of the digital microfluidics system 1.

It is further preferred that the base unit 7 comprises actuating elements 38 that are configured for actuating plungers 42 that in each case are configured to be movable within a compartment 21 of a disposable cartridge 2 that is placed on the cartridge accommodation site 8. Thus, the plungers 42 in each case are configured for pressing the content of the respective compartment 21 into the gap 6 of the disposable cartridge 2 that is located on the cartridge accommodation site 8 of the base unit 7. Preferably, the actuating elements 38 are configured to be motor driven and controlled by the central control unit 14 of the digital microfluidics system 1. The insertion guide 25 preferably is manufactured from aluminum, from another light metal or light alloy, or from stainless steel.

The FIG. 5 shows a section view of the disposable cartridge 2 of FIG. 3. The flexible bottom layer 3 of the disposable cartridge 2 according to a third embodiment is attracted by underpressure and spread over the electrode array 9, the bottom substrate 11, and over the waste hollow 50 in the bottom substrate 11 of the digital microfluidics system 1. The bottom layer 3 of the disposable cartridge 2 is configured to be flexible and the waste hollow 50 is configured as a depression or hole in the bottom substrate 11 of the digital microfluidics system 1. As depicted, the depression in the bottom substrate 11 provides additional space for the waste hollow without the necessity of punching a through hole into the PCB 11. If however, additional space for collection and/or storage of waste fluids is needed, there can be arranged a deeper depression or through hole in the PCB. If instead of a PCB from plastic material, the bottom substrate 11 is chosen to be produced from a ceramics material like e.g. $SiO_2$, or $Al_2O_3$ that is thicker than the plastic PCB, deeper depression or again a through hole though the entire bottom substrate 11 may provide even more space for collecting and/or storing waste fluids.

Preferably, for the accommodation of such a disposable cartridge 2 of the third embodiment, the digital microfluidics system 1 further comprises:

(e) a number of suction holes 35 that penetrate the bottom substrate 11 and the electrode array 9 and that are distributed over the cartridge accommodation site 8 of the base unit 7 and over the waste hollow 50;

(f) a vacuum source 33 for establishing an underpressure in an evacuation space 46 that is located between the electrode array 9 or bottom substrate 11 and a disposable cartridge 2 located thereon; and (g) a number of vacuum lines 34 that link the suction holes 35 to the vacuum source (33).

In such a digital microfluidics system 1, the flexible bottom layer 3 of the disposable cartridge 2 is preferably configured to be attracted by the underpressure in the evacuation space 46 and to be spread over the electrode array 9, the bottom substrate 11, and over the waste hollow 50 in the bottom substrate 11. In consequence, the flexible bottom layer 3 is sucked down into the depression or through hole in the bottom substrate 11. Thus, the flexible bottom layer 3 that defines the gap height 53 of the gap 6 between the bottom layer 3 and the top layer 4 of the disposable cartridge 6 also defines the area and height 51 of the waste hollow 50.

Preferably, the flexible bottom layer 3 of the disposable cartridge 2 is configured as a monolayer of a hydrophobic material. Alternatively, the flexible bottom layer 3 of the disposable cartridge 2 is configured as a monolayer of electrically non-conductive material, an upper surface of the flexible bottom layer 3 being treated to be a hydrophobic surface 17'. In a further alternative version, the flexible bottom layer 3 of the disposable cartridge 2 is configured as a laminate comprising a lower layer and a hydrophobic upper layer, the lower layer being electrically conductive or non-conductive.

It is especially preferred that the disposable cartridge 2 of the third embodiment comprises a body 47 with at least one compartment 21 that is configured to hold therein processing liquids, reagents or samples. At least one of these compartments 21 preferably comprises a through hole 19 for delivering on request at least some of its content into the gap 6.

The FIG. 6 shows a section view of a disposable cartridge 2 of FIG. 4. The disposable cartridge 2 according to a fourth embodiment comprises a body 47, in which the waste hollow 50 is located. The waste hollow is arranged in fluidic communication with the gap 6 that is located between the bottom layer 3 and the top layer 4 of the disposable cartridge 2. As can be seen in FIG. 6, the height 51 of the waste hollow 50 includes the height 53 of the gap 6.

Preferably, the body 47 of the disposable cartridge 2 comprises at least one compartment 21 that is configured to hold therein processing liquids, reagents or samples. At least one of these compartments 21 comprises a through hole 19 for delivering at least some of its content into the gap 6 on demand. Preferably, the body 47 of the disposable cartridge 2 is configured as the top layer 4 of the disposable cartridge 2 and comprises the second hydrophobic surface 17".

It is preferred that the bottom layer 3 of the disposable cartridge 2 of this fourth embodiment is configured as a monolayer of a hydrophobic material. Alternatively, the bottom layer 3 of the disposable cartridge 2 is configured as a monolayer of electrically non-conductive material, an upper surface of the bottom layer 3 being treated to be a hydrophobic surface 17'. In a further alternative version, the bottom layer 3 of the disposable cartridge 2 is configured as a laminate comprising a lower layer and a hydrophobic upper layer, the lower layer being electrically conductive or non-conductive.

When combining the third and fourth embodiments of the disposable cartridge 2, the bottom layer 3 of the disposable cartridge 2 is configured to be flexible and to be attracted by an underpressure in an evacuation space 46 that is located between the electrode array 9 or bottom substrate 11 and a disposable cartridge 2 located thereon.

Preferably, the disposable cartridge 2 comprises a cushion seat 57, in which is located an absorptive cushion 55 for collecting waste fluids. It is especially preferred that the absorptive cushion 55 comprises a semi-permeable membrane 56 that is configured to admit waste liquids to permeate into the absorptive cushion 55 and to prevent the waste liquids from leaving the absorptive cushion 55. Preferably, such a semi-permeable membrane 56 may be freely penetrated by gases.

For safety reasons, it may be provided that the disposable cartridge 2 comprises a cover 58 that encloses the cushion seat 57 in the body 47. Such a cover 58 may be part of the body 47 of the disposable cartridge 2. Depending on the amount and type of liquids needed for processing the samples in the gap 6 of the cartridge 2, the cover may be completely closing the cushion seat 57 in the body 47. The cover 58 may alternatively be of an adhesive tape or foil that is attached to the upper surface 49 of the body 47. Therefore, to an upper surface 49 of the body 47 of the disposable cartridge 2 there is sealingly applied an elastic layer 44 or a plate that is configured to seal at least the cushion seat 57 in the body 47 against said upper surface 49.

Alternatively and also depending on the amount and type of liquids needed for processing the samples in the gap 6 of the cartridge 2, the cover 58 of the disposable cartridge 2 may comprise at least one ventilation duct 59 that is configured to let pass air (or other gases) arriving from the absorptive cushion 55 and thereby to avoid any building up of overpressure in at least one of the gap 6, the waste hollow 50, the cushion seat 57, and the absorptive cushion 55.

It has been observed that liquid droplets 23, when moved over a path of individual electrodes 10 and at an end of this path over an individual waste electrode 52, the droplet easily slips into the waste hollow 50 (independent from the chosen embodiment of the latter). If there is already a waste depot 54 present in the waste hollow 50, the droplet 23 will merge with this larger liquid volume. Ease of slipping into the waste hollow may be explained by reduction of contact area between the droplet 23 and the hydrophobic surfaces 17' and 17". It is thus proposed that the droplet 23 takes a lower energy level when assuming its location inside a waste hollow 50. It has been observed that the droplets 23 or waste depots 54 never leave spontaneously a waste hollow again.

The FIG. 7 shows a top view of an electrode layout of a system for liquid droplet manipulation of US 2013/0020202 A1 in which is incorporated a waste hollow 50 according to the first alternative solution as shown in FIG. 5. When comparing the area of this waste hollow 50 with the area of an individual waste electrode 52, it is immediately clear that the area of the waste hollow 50 is much larger. Two different waste depots 54 are indicated at the end of two different electrode paths.

When comparing the area of this waste hollow 50 with the area of a waste electrode that is located close to the lower border of the PCB, it is again clear that the area of the waste hollow 50 is much larger. According to the invention, the volume of waste liquids that can be stored in the waste hollow 50 will be a multitude of the volume of waste liquids that can be stored on the large waste electrode. This is because of the height 51 of the waste hollow 50 that is at least twice the gap height 53 of the disposable cartridge 2. In FIG. 7, the reference numbers that refer to the features of the present invention are printed in bold letters. For explanation of the reference numbers in FIG. 7 that are printed in Italics please see the captions to FIG. 9 of US 2013/0020202 A1.

The following materials and dimensions are especially preferred for manufacturing a disposable cartridge 2 for use in the digital microfluidics system 1 of the present invention:

TABLE 1

| Part | No. | Material | Dimensions and Shape |
|---|---|---|---|
| Bottom layer | 3 | Fluorinated ethylene propylene (FEP), Cyclo olefin polymer (COP) | Foil: 8-50 μm |
| Top layer | 4 | Al foil | Foil: 20-100 μm |
| Gap | 6 | — | Height: 0.2-2.0 mm; preferably 0.5 mm |
| Electrodes | 10 | Al; Cu; Au; Pt | Plating: 1.5 × 1.5 mm |
| Bottom substrate | 11 | Plastic; ceramic, glass | 1-10 mm |
| Cover plate | 12 | Mylar ®; acrylic | Foil, plate: 0.15-1.8 mm; preferably 1.5 mm |
| Electrically conductive material | 15 | Au, Pt, TIO, PP, PA | Layer: 20-100 μm; preferably 50 μm |
| 1st hydrophobic surface | 17' | COP, FEP | Foil: 8-50 μm |
| 2nd hydrophob. surface | 17" | Teflon ® | Spin coating: 5-500 nm; preferably 20 nm |
| Liquid droplet | 23 | — | Volume: 0.1-5 μl |
| Dielectric layer | 24 | Fluorinated ethylene propylene, FEP | Foil or casting: 20-100 μm |
| Insertion guide | 25 | Al; Al/Mg; steel; PTFE | Frame: 5-30 mm |
| Gasket | 36 | Synthetic or natural rubber | Frame: 0.2-2.0 mm; preferably 0.5 mm |
| Pipetting orifice | 41''' | — | Diameter: 0.3-3.0 mm |
| Elastic layer | 44 | Synthetic or natural rubber | Foil: 0.5-2.0 mm |
| Body | 47 | Polypropylene, PP | 65 × 85 mm; 6-25 mm |

The inventive disposable cartridge 2 and the inventive digital microfluidics system 1 enable an alternative method for manipulating samples in liquid droplets 23 that adhere to a hydrophobic surface 17 to be carried out. This method preferably comprises the steps of:

(a) providing a disposable cartridge 2 with a first hydrophobic surface 17' of a bottom layer 3, with a second hydrophobic surface 17" of a top layer 4, and with a gap 6 between the first and second hydrophobic surfaces 17',17", the disposable cartridge 2 further comprising a body 47 with at least one compartment 21 to therein hold processing liquids, reagents or samples, said compartment 21 comprising a through hole 19 for delivering at least some of its content to the gap 6;

(b) providing a digital microfluidics system 1 with an electrode array 9 that substantially extends in a first plane and that comprises a number of individual electrodes 10 supported by a bottom substrate 11 and connected to a central control unit 14 of the digital microfluidics system 1 for controlling the selection of individual electrodes 10 of said electrode array 9 and for providing these electrodes 10 with individual voltage pulses for manipulating said liquid droplets 23 on said first hydrophobic surface 17' by electrowetting; and (c) defining the gap 6 so that the hydrophobic surface 17" of the top layer 4 extends substantially parallel to and in a distance to said first hydrophobic surface 17' of the bottom layer 3.

This method preferably further comprises the steps of:

(d) providing the bottom layer 3 as a flexible film that is sealingly attached to the top layer 4 along a circumference 40 of the flexible bottom layer 3, the disposable cartridge 2 thus being devoid of a spacer 5 that is located between the flexible bottom layer 3 and the top layer 4 for defining a particular distance between said first hydrophobic surface 17' and said second hydrophobic surface 17";

(e) placing the disposable cartridge 2 on a cartridge accommodation site 8 of a base unit 7 of the digital microfluidics system 1, the top layer 4 being configured to provide a seal between a lower end of at least one compartment 21 and the gap 6, and the top layer 4 comprising loading sites 41 for transferring processing liquids, reagents or samples into the gap 6;

(f) sealing in the cartridge accommodation site 8 an evacuation space 46 by a gasket 36 located around a circumference 45 of the cartridge accommodation site 8, the evacuation space 46 being defined by the flexible bottom layer 3, the electrode array 9, the bottom substrate 11, and the gasket 36; and (g) creating in the evacuation space 46 an underpressure, which causes the flexible bottom layer 3 of the disposable cartridge 2 that is placed on the cartridge accommodation site 8 to be attracted and spread over the electrode.

When applying this method, preferably the underpressure in the evacuation space 46 is created by a vacuum source 33, which is controlled by the central control unit 14 of the digital microfluidics system 1, and which is linked by a number of vacuum lines 34 to suction holes 35 that penetrate the electrode array 9 and that are distributed over the cartridge accommodation site 8 of the base unit 7. It is further preferred that a plunger 42 contained in a compartment 21 of the disposable cartridge 2 is moved manually or by an actuating element 38 and the content of the respective compartment 21 is pressed against a respective loading site 41 of the top layer 4. It is also preferred that with a piercing pin 27 of the plunger 42, the top layer 4 is pierced at a respective piercing site 41' of the compartment 21 and some of the content of the compartment 21 is pressed through a hole punched into this piercing site 41' of the top layer 4 and into the gap 6. Alternatively or additionally, it is also preferred that some of the content of the compartment 21 is pressed with the plunger 42 through a respective capillary orifice of the top layer 4 and into the gap 6, the capillary orifice being sized to exhibit capillary forces that prevent flowing though of aqueous liquids without a pressure being applied with the plunger 42.

In each case it is preferred that after manipulating liquid droplets 23 on said first hydrophobic surface 17' by electrowetting and/or analyzing the sample in some of these liquid droplets 23, the disposable cartridge 2 is taken from the cartridge accommodation site 8 of the base unit 7 of the digital microfluidics system 1 and discarded.

Any combination of the features of the different embodiments of the cartridge 2 disclosed herein that appear reasonable to a person of skill are comprised by the gist and scope of the present invention.

Even if they are not particularly described in each case, the reference numbers refer to similar elements of the digital microfluidics system 1 and in particular of the disposable cartridge 2 of the present invention.

| Reference numbers: | |
|---|---|
| 1 | digital microfluidics system |
| 2 | disposable cartridge |
| 3 | bottom layer |
| 4 | top layer |
| 5 | spacer |
| 6 | gap between 3 and 4 |
| 7 | base unit |
| 8 | cartridge accommodation site |
| 9 | electrode array |
| 10 | individual electrode |
| 11 | bottom substrate |
| 12 | cover plate |
| 13 | top substrate |
| 14 | central control unit |
| 15 | electrically conductive material |
| 16 | hinge |
| 17 | hydrophobic surface |
| 17' | 1st hydrophobic surface |
| 17" | 2nd hydrophobic surface |
| 19 | through hole |
| 21 | compartment |
| 23 | liquid droplet |
| 24 | dielectric layer |
| 25 | insertion guide |
| 26 | disposable pipette tip, pipette tip |
| 27 | piercing pin |
| 33 | vacuum source |
| 34 | vacuum line |
| 35 | suction hole |
| 36 | gasket |
| 37 | clamp |
| 38 | actuating element |
| 40 | circumference of 3 |
| 41 | loading site |
| 41' | piercing site |
| 41"' | pipetting orifice |
| 42 | plunger |
| 43 | central opening |
| 44 | elastic layer |
| 45 | circumference of 8 |
| 46 | evacuation space |
| 47 | body |
| 48 | lower surface of 47 |
| 49 | upper surface of 47 |
| 50 | waste hollow |
| 51 | height of waste hollow |
| 52 | individual waste electrode |
| 53 | height of gap |
| 54 | waste depot |
| 55 | absorptive cushion |
| 56 | semi-permeable membrane |
| 57 | cushion seat |

-continued

| Reference numbers: | |
|---|---|
| 58 | cover |
| 59 | ventilation duct |

What is claimed is:

1. A digital microfluidics system (1) for manipulating samples in liquid droplets within a gap (6) of at least one disposable cartridge (2), the digital microfluidics system (1) comprising:

(a) a base unit (7) with at least one cartridge accommodation site (8) that is configured for taking up a disposable cartridge (2);

(b) a disposable cartridge (2) that comprises a gap (6) with a gap height (53), a bottom layer (3) with a first hydrophobic surface (17'), and a top layer (4) with a second hydrophobic surface (17"), said disposable cartridge (2) being placed at said at least one cartridge accommodation site (8);

(c) an electrode array (9) located at said at least one cartridge accommodation site (8) of the base unit (7), the electrode array (9) being supported by a bottom substrate (11), extending in a first plane, and comprising a number of individual electrodes (10); and (d) a central control unit (14) for controlling the selection of the individual electrodes (10) of said electrode array (9) and for providing these individual electrodes (10) with individual voltage pulses for manipulating liquid droplets within the gap (6) of said disposable cartridge (2) by electrowetting, wherein the digital microfluidics system (1) further comprises a waste hollow (50) which is fluidly connected with the gap (6) in that the waste hollow (50) is located next to at least one individual waste electrode (52) that is positioned next to at least one individual electrode (10), the at least one individual waste electrode (52) being operatively connected to the central control unit (14) and covering in each case a waste electrode area, said waste hollow (50) covering a waste area that is equal to a multitude of said waste electrode area and said waste hollow (50) having a height (51) that is equal to a multitude of the gap height (53);

wherein the bottom layer (3) of the disposable cartridge (2) is configured to be flexible and the waste hollow (50) is configured as a depression or hole in the bot-tom substrate (11) of the digital microfluidics system (1), wherein the digital microfluidics system (1) further comprises:

(e) a number of suction holes (35) that penetrate the bottom substrate (11)

and the electrode array (9) and that are distributed over the cartridge ac-commodation site (8) of the base unit (7) and over the waste hollow (50);

(f) a vacuum source (33) for establishing an underpressure in an evacuation space (46) that is located between the electrode array (9) or bottom sub-strate (11) and a disposable cartridge (2) located thereon; and (g) a number of vacuum lines (34) that link the suction holes (35) to the vacuum source (33);

and wherein the flexible bottom layer (3) of the disposable cartridge (2) is config-ured to be attracted by the underpressure in the evacuation space (46) and to be spread over the electrode array (9), the bottom substrate (11), and over the waste hollow (50) in the bottom substrate (11) of the digital microfluidics system (1), the flexible bottom layer (3) thereby defining the gap height (53) of the gap (6) between the bottom layer (3) and the top layer (4) of the disposable cartridge (6) and also the area and height (51) of the waste hollow (50).

2. The digital microfluidics system (1) of claim 1, wherein the flexible bottom layer (3) of the disposable cartridge (2) is configured as a monolayer of a hydrophobic material.

3. The digital microfluidics system (1) of claim 1, wherein the flexible bottom layer (3) of the disposable cartridge (2) is configured as a monolayer of electrically non-conductive material, an upper surface of the flexible bottom layer (3) being treated to be a hydrophobic surface (17').

4. The digital microfluidics system (1) of claim 1, wherein the flexible bottom layer (3) of the disposable cartridge (2) is configured as a laminate comprising a lower layer and a hydrophobic upper layer, the lower layer being electrically conductive or non-conductive.

5. The digital microfluidics system (1) of claim 1, wherein the disposable cartridge (2) comprises a body (47) with at least one compartment (21) configured to hold therein processing liquids, reagents or samples, at least one of said compartments (21) comprising a through hole (19) for delivering at least some of its content into the gap (6).

6. The digital microfluidics system (1) of claim 1, wherein a gasket (36), when located around a circumference (45) of the cartridge accommodation site (8), seals in the cartridge accommodation site (8) the evacuation space (46), which is defined by the flexible bottom layer (3), the electrode array (9), the bottom substrate (11), and the gasket (36).

7. The digital microfluidics system (1) of claim 1, wherein the disposable cartridge (2) comprises a body (47), in which body (47) the waste hollow (50) is located, the waste hollow (50) being in fluidic communication with the gap (6) that is located between the bottom layer (3) and the top layer (4) of the disposable cartridge (2); the height (51) of the waste hollow (50) including the height (53) of the gap (6).

8. The digital microfluidics system (1) of claim 7, wherein the body (47) of the disposable cartridge (2) comprises at least one compartment (21) configured to hold therein processing liquids, reagents or samples, at least one of said compartments (21) comprising a through hole (19) for delivering at least some of its content into the gap (6).

9. The digital microfluidics system (1) of claim 7, wherein the body (47) of the disposable cartridge (2) is configured as the top layer (4) of the disposable cartridge (2) and comprises the second hydrophobic surface (17").

10. The digital microfluidics system (1) of claim 7, wherein the bottom layer (3) of the disposable cartridge (2) is configured as a monolayer of a hydrophobic material.

11. The digital microfluidics system (1) of claim 7, wherein the bottom layer (3) of the disposable cartridge (2) is configured as a monolayer of electrically non-conductive material, an upper surface of the bottom layer (3) being treated to be a hydrophobic surface (17').

12. The digital microfluidics system (1) of claim 7, wherein the bottom layer (3) of the disposable cartridge (2) is configured as a laminate comprising a lower layer and a hydrophobic upper layer, the lower layer being electrically conductive or non-conductive.

13. The digital microfluidics system (1) of claim 7, wherein the disposable cartridge (2) comprises a cushion seat (57), in which is lo-cated an absorptive cushion (55) for collecting waste fluids.

14. The digital microfluidics system (1) of claim 13, wherein the absorptive cushion (55) comprises a semi-permeable membrane (56) that is configured to admit waste liquids to permeate into the absorptive cushion (55) and to prevent the waste liquids from leaving the absorptive cushion (55).

15. The digital microfluidics system (1) of claim 13, wherein the disposable cartridge (2) comprises a cover (58) that encloses the cushion seat (57) in the body (47).

16. The digital microfluidics system (1) of claim 15, wherein the cover (58) of the disposable cartridge (2) comprises at least one ventilation duct (59) that is configured to let pass air arriving from the absorptive cushion (55) and thereby to avoid building up an overpressure in at least one of the gap (6), the waste hollow (50), the cushion seat (57), and the absorptive cushion (55).

17. The digital microfluidics system (1) of claim 13, wherein to an upper surface (49) of the body (47) of the disposable cartridge (2) is sealingly applied an elastic layer (44) that is configured to seal at least the cushion seat (57) in the body (47) against said upper surface (49).

* * * * *